United States Patent [19]

Bailey et al.

[11] Patent Number: 4,926,676

[45] Date of Patent: May 22, 1990

[54] FORMING PROCESS FOR PRODUCING SHARP CORNERS IN SHEET METAL

[75] Inventors: Lowell Bailey, Long Beach; Hervey Libbert, Redondo Beach, both of Calif.

[73] Assignee: Lane & Roderick, Inc., Santa Fe Springs, Calif.

[21] Appl. No.: 332,416

[22] Filed: Mar. 30, 1989

Related U.S. Application Data

[63] Continuation of Ser. No. 93,409, Sep. 4, 1987, abandoned.

[51] Int. Cl.[5] ..... B21D 9/08

[52] U.S. Cl. ..... 72/389; 72/414; 72/464

[58] Field of Search ..... 72/414, 413, 389, 384, 72/478, 464

[56] References Cited

U.S. PATENT DOCUMENTS

| | | | |
|---|---|---|---|
| 2,023,638 | 12/1935 | Lawson | 72/389 |
| 2,421,457 | 6/1947 | Linsay | 72/414 |
| 2,847,053 | 8/1958 | Hardman | 72/414 |
| 3,440,847 | 4/1969 | Giordano | 72/414 |
| 3,702,558 | 11/1972 | Swenson et al. | 72/389 |
| 3,757,559 | 9/1973 | Welsh | 72/369 |
| 3,978,706 | 9/1976 | Nakagawa et al. | 72/389 |
| 4,391,119 | 7/1983 | Schmitz | 72/384 |
| 4,403,498 | 9/1983 | Holtschmidt | 72/455 |
| 4,486,841 | 12/1984 | Koyama et al. | 72/389 |
| 4,489,578 | 12/1984 | Nagai et al. | 72/21 |
| 4,489,586 | 12/1984 | Hess | 72/389 |
| 4,580,434 | 4/1986 | Graf | 72/389 |

FOREIGN PATENT DOCUMENTS

| | | | |
|---|---|---|---|
| 745688 | 4/1970 | Fed. Rep. of Germany | 72/389 |
| 1016040 | 10/1952 | France | 72/412 |
| 0625757 | 2/1979 | Japan | 72/389 |
| 0047024 | 3/1984 | Japan | 72/389 |
| 0009928 | 1/1986 | Japan | 72/389 |
| 616093 | 3/1980 | Switzerland | 72/389 |
| 1038001 | 8/1983 | U.S.S.R. | 72/414 |
| 2122521 | 1/1984 | United Kingdom | 72/389 |

OTHER PUBLICATIONS

"One di-acro rol-form die", di-acro product O'-Neil-Irwin MFG., Co., 1958.

"Press Brake Die Manual", Power Brake Dies, Inc., 1974, pp. 1 and 15.

*Primary Examiner*—David Jones

*Attorney, Agent, or Firm*—Bryan, Cave, McPheeters & McRoberts

[57] ABSTRACT

A forming process for producing sharp corners in sheet metal workpieces, and a press brake useful in carrying out such a process, involving a male forming die incorporating a nipple for extruding the sheet metal stock material into the adjacent region defined by the female coining die for forming a sharp corner in the workpiece.

1 Claim, 1 Drawing Sheet

FORMING PROCESS FOR PRODUCING SHARP CORNERS IN SHEET METAL

This is a continuation of U.S. application Ser. No. 093,409, filed 9/4/87, now abandoned.

BACKGROUND OF THE INVENTION

The present invention relates to a forming process for producing sharp corners in sheet metal, and to a press brake useful in carrying out such process.

Sheet metal products having sharp corners formed therein are highly desirable for particular applications, e.g., for aluminum store fronts and aluminum window frame components. Such corners are ordinarily formed by extrusion techniques necessitating heating the stock, and requiring special tooling. These techniques are only economical for projects requiring tens of thousands of square feet of extruded shapes. Large panel sheet metals and large channels cannot be handled by extrusion, nor can specialty products.

Press brakes for forming bends in sheet metal are also well known in the art. See, e.g., U.S. Pat. Nos. 4,580,434; 4,489,586, 4,489,578; 4,486,841; and 3,978,706. However, conventional press brake tooling does not produce sharp corners in sheet metal but rather form what is known in the art as "radius" bends. Illustrations of radius bends appear in Graf U.S. Pat. No. 4,580,434, FIGS. 7, 16 and 17; and Koyama et al U.S. Pat. No. 4,486,841, FIG. 9.

In some press brakes for bending sheet metal, the lower die has an indentation or well extending longitudinally along its length. See, e.g., Holtschmidt U.S. Pat. No. 4,403,498; and Swenson et al U.S. Pat. No. 3,702,558. This configuration allows the workpiece metal to flow into the well. The resulting bend is a deformed radius bend whose radius extends beyond the lines necessary to form a sharp corner in the metal. A sharp corner may subsequently be formed by grinding the excess metal contained in the extended radius to form a sharp outer corner. This technique requires several steps, is cumbersome, and is labor-intensive.

A two-step method for producing sharp corners in sheet metal is disclosed in Lawson U.S. Pat. No. 2,023,638. The first step comprises conventional forming to produce a radius bend. The second step comprises compressing the workpiece in the area of the bend with a special male die that extrudes the metal into the sharp corner of the female die (see FIGS. 4 and 5 of Lawson). The special die comprises a split, expandable die formed from a pair of displaceable jaws, each of which has a number of saw teeth which are displaced from the plane along which the workpiece is to be bent. Upon compression of the workpiece, the saw teeth cause the metal stock to flow into and completely fill the female die cavity. However, extrusion of the metal stock increases the thickness of the stock in addition to forming a sharp corner therein (see FIG. 6 of Lawson). Besides requiring multiple operations, the technique described in the Lawson patent thus produces sheet metal products having varying gauges.

SUMMARY OF THE INVENTION

The present invention provides a simple and economical metal forming process, and press brake tooling useful therein, for producing sharp corners in sheet metals. The process and apparatus are useful in many, if not all areas of application, where the formation of sharp corners in metal stock, e.g., aluminum stock, is desirable. The process results in improved economy and cost effectiveness in the processing of a wide variety of sheet metal products including, but not limited to, low volume products, oversized sheet metal panels, specialty products, and the like.

The forming process of the invention involves bending a sheet metal workpiece along at least one transverse plane thereof, and impressing an additional forming force on the sheet metal in alignment with the plane to extrude the metal adjacent the plane and form a sharp corner in the sheet metal. The forming process is carried out by bending the sheet metal workpiece between two forming dies, the female die comprising a pair of intersecting planar surfaces which may, for example, be disposed at right angles to one another, and the male die impressing the additional forming force in alignment with the intersection of the planar surfaces of the female die, to thereby extrude the sheet metal stock into the region adjacent the intersection and thereby form a sharp corner in the sheet metal without, however, materially increasing the thickness of the bent stock.

BRIEF DESCRIPTION OF THE DRAWING

The nature and advantages of the forming process and press brake of the invention will be more fully apparent from consideration of the following detailed description taken in connection with the annexed drawing, in which.

DETAILED DESCRIPTION OF THE INVENTION

Figures 1, 2, 3, 4:
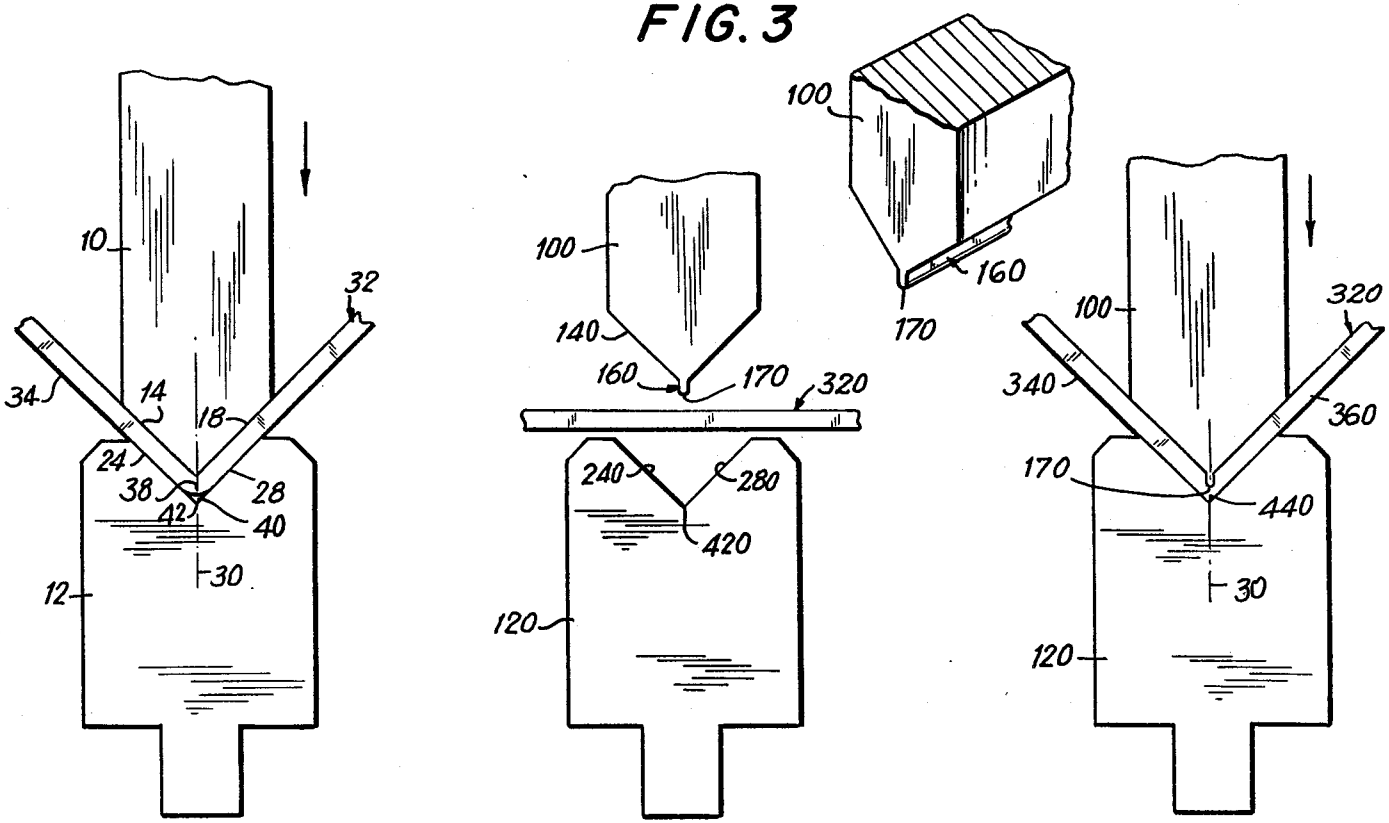
FIG. 1 PRIOR ART
FIG. 1 is a partial, schematic end view of a press brake having a conventional upper, male die and a lower female die in the closed position, with a sheet metal workpiece bent therebetween.
FIG. 2 is a partial, schematic end view of a press brake embodying the present invention, in an open position prior to bending a planar sheet metal workpiece between the upper and lower dies thereof.
FIG. 3 is a broken, perspective view of the male die of the press brake of FIG. 2.
FIG. 4 is a partial, schematic end view of the press brake of FIG. 2 in the closed position.

Referring to the drawing, a conventional press brake for bending sheet metal stock is illustrated in FIG. 1, comprising an upper, male die 10 and a lower, female die 12. The male die comprises a pair of intersecting planar surfaces 14 and 18, whereas the female die comprises a corresponding pair of intersecting planar surfaces 24 and 28, defining an intermediate bending plane 30 about which sheet metal stock is bent. As illustrated in FIG. 1, initially planar sheet metal stock 32 is thus bent between the dies to form legs 34 and 36 therein. As illustrated, the female die 12 defines a generally V-shaped corner element for forming a sharp corner in workpiece 32 along the plane 30.

While, as shown, the surfaces 24 and 28 are generally orthogonal, for forming a right-angle bend in workpiece 32, it will be understood that any desired angle may be formed by appropriate design of the forming dies. Whatever the die chosen, however, employing a conventional press brake a radius bend 38 is formed in the stock material, leaving a space 40 adjacent the intersection 42 of surfaces 24 and 26 rather than a sharp corner in the sheet metal.

In contrast to the conventional press brake of FIG. 1, FIG. 2 illustrates the end view of an upper die 100 and a lower die 120 of the present invention. The upper die 100 has a nipple or ridge 160 machined at the intersection of die surfaces 140 and 180, extending lengthwise of the upper die 100 and transversely of the workpiece 320 to be bent thereby, as illustrated in FIG. 3. The lower die 120 defines a sharp corner at the intersection 420 between the intersecting surfaces 240 and 280 thereof. The workpiece 320 is placed between the two dies.

As shown in FIG. 3, the nipple 160 has a rounded cross-section or at least a rounded contact surface 170; alternatively, it may have any desired shape capable of extruding the metal into the female die 120 adjacent the intersection 420 of the V-shaped surfaces 240 and 280 of die 120.

Preferably, as illustrated in FIG. 4, the male die 100 is then lowered to contact the workpiece 320 and additional pressure is applied to the upper die to force the workpiece into the female die 120. The nipple 160 extrudes metal from the workpiece 320 into the sharp corner zone adjacent the bending plane 30 and the intersection 420 of surfaces 240 and 280 defining die 120. The metal stock is thus formed by a single operation (defined as one compression cycle of dies 100 and 120 from the open position of FIG. 2 to the closed position of FIG. 4, and back to the open position of FIG. 2) into a sharp corner element 440. No other operations need be applied to the workpiece to produce the sharp corner.

The process and apparatus of the present invention is preferably utilized for the forming of aluminum. It may, however, be applied to any type of compressible sheet metal capable of being formed into a bend by a press brake. Thus, sheet metals of varying compositions, thicknesses, or widths may be formed into any desired corner angles. It should be understood that male die 100 having nipple 160 machined thereon should be designed in accordance with the particular thickness and type of sheet metal to be bent, such design and dimensions being within the scope of those skilled in the art.

Although only a single preferred embodiment of the present invention has been specifically described, it will be apparent that the process and press brake are capable of further modification within the scope of the invention; accordingly, the preceding description should be construed as illustrative only, the scope of the invention to be determined from the following claims.

What is claimed is:

1. A process for producing a sharp corner in a sheet metal workpiece along a transverse plane thereof, which comprises:

(a) placing the workpiece between a pair of forming dies, the first, female die being in the form of a first pair of generally orthogonally directed intersecting planar surfaces, the second, male die being in the form of a second pair of generally orthogonally directed intersecting planar surfaces having a nipple machined on the intersection of said second pair of surfaces and extending lengthwise thereof, the intersections of said surfaces being aligned with one another and with the transverse plane in the workpiece, and said nipple having a first dimension extending a substantial distance in the direction of the female die and a second dimension extending lengthwise of said dies defining a volume sufficient to displace the workpiece into substantially all of the region of the female die adjacent the intersection of said first pair of intersecting planar surfaces;

(b) forcing the workpiece into contact with said forming dies to bend it, in a single operation, along said transverse plane, the nipple imposing an additional forming force on the sheet metal to penetrate into at least about $\frac{1}{2}$ of its thickness and displace a substantial amount of the sheet metal into said region and thereby form the sharp corner in the workpiece.

* * * * *